US008302998B2

(12) United States Patent
Gokkel

(10) Patent No.: US 8,302,998 B2
(45) Date of Patent: Nov. 6, 2012

(54) BINDING SYSTEM, SHEET FOR APPLIANCE IN A BINDING SYSTEM AND USE OF A BINDING SYSTEM

(75) Inventor: Paul Gokkel, CG Bloemendaal (NL)

(73) Assignee: Innobind Holding B.V. (NL)

( * ) Notice: Subject to any disclaimer, the term of this patent is extended or adjusted under 35 U.S.C. 154(b) by 1012 days.

(21) Appl. No.: 11/816,645

(22) PCT Filed: Feb. 21, 2006

(86) PCT No.: PCT/NL2006/000088

§ 371 (c)(1),
(2), (4) Date: Aug. 20, 2007

(87) PCT Pub. No.: WO2006/091078

PCT Pub. Date: Aug. 31, 2006

(65) Prior Publication Data

US 2008/0157516 A1 Jul. 3, 2008

(30) Foreign Application Priority Data

Feb. 22, 2005 (NL) ..... 1028365
Dec. 23, 2005 (NL) ..... 1030759

(51) Int. Cl.
*B42D 1/00* (2006.01)
*B42D 5/00* (2006.01)

(52) U.S. Cl. ..... 281/21.1; 281/38

(58) Field of Classification Search ..... 281/2, 5, 281/9, 21.1, 38, 46
See application file for complete search history.

(56) References Cited

U.S. PATENT DOCUMENTS 50,521 A * 10/1865 Velthouen et al. ..... 281/21.1
59,323 A * 10/1866 Velthouen ..... 281/21.1
2,349,947 A * 5/1944 Henry Einzig ..... 281/21.1

FOREIGN PATENT DOCUMENTS

| | | | |
|---|---|---|---|
| DE | 242788 | A | 1/1912 |
| DE | 7531018 | U | 3/1976 |
| FR | 1252131 | A | 1/1961 |
| GB | 190924983 | A | 0/1910 |
| GB | 257322 | A | 8/1926 |
| JP | 52020127 | | 2/1977 |
| WO | 0178995 | A1 | 10/2001 |

* cited by examiner

*Primary Examiner* — Dana Ross
*Assistant Examiner* — Kyle Grabowski
(74) *Attorney, Agent, or Firm* — Brooks Kushman P.C.

(57) ABSTRACT

A binding system (1) comprising a stack of sheet (2), each with a binding side (3) with attachment means for the connection of the sheets. The binding side of a sheet possesses an alternating sequence of tabs and notches. One sheet can be attached to an adjacent sheet by interlocking its tab (4) into the notches between the corresponding tabs of the adjacent sheet. The tabs fit exactly into these notches to provide a seamless connection between these sheets. Thus this binding system provides for a quick, user-friendly binding system without requiring separate and cumbersome attachment means.

18 Claims, 3 Drawing Sheets

Figure 1:
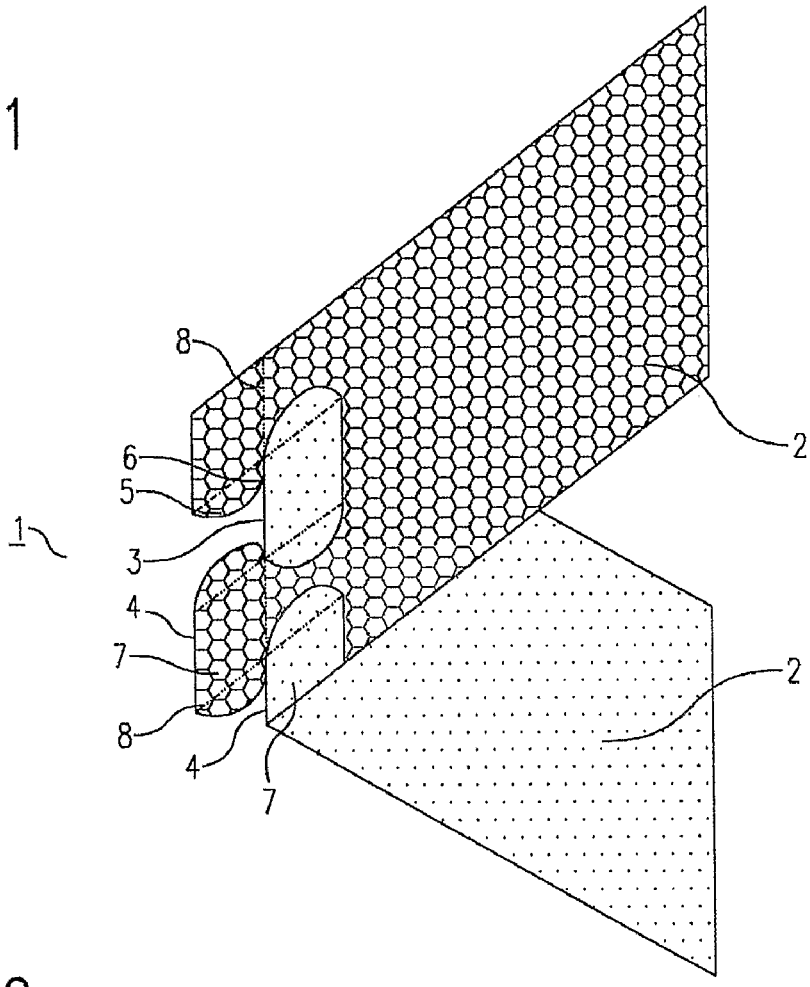

BINDING SYSTEM, SHEET FOR APPLIANCE IN A BINDING SYSTEM AND USE OF A BINDING SYSTEM

The present invention relates to a binding system, comprising a stacking of sheets that are mutually connected at a common binding edge using attachment means. Said sheets are provided with tabs and notches at their binding edge.

Binding systems using sheets with tabs and notches are well known in the patent literature. GB190924983 describes sheets provided with tabs and notches that can be attached to a cover. GB257322 describes tabbed sheets with notches, through which anchoring bars can be clung. JP52020127 and WO0178995 use sheets with notches and tabs that can be glued together. The glue penetrates the notches to obtain a stronger adhesion in these cases. A disadvantage of such a binding system is the drying time that is needed for this glue, the lack of durability and the special means needed to implement the adhesive. Also said attachment means need to be purchased separately increasing therefore the cost price and requiring a certain stock. Many alternative existing binding systems use binding combs or binding covers to bind loose leafs. To handle booklets of varying thickness several sizes of such combs or covers are required. The present invention has the purpose to provide for a binding system that alleviates the above problems and disadvantages as mentioned. To achieve the intended purpose the binding system as mentioned according to the invention is characterised by attachment means comprising tabs, regularly positioned on the binding edge of each sheet. Between two neighbouring tabs there is situated a notch. During the binding process according to the present invention the tabs of one sheet are inserted into the notches of an adjacent sheet to attach these sheets. In this way a reliable attachment is attained, with tabs of successive sheets co-operating to implement a mutual connection, in which further connection means like glue, binding combs or covers are redundant. If required, loose sheets can be added to the bound sheets or sheets can be removed from these bound sheets.

This yields both economic as well as practical advantages, through which the home use of such a binding system is stimulated.

A preferred embodiment of the binding system according to the invention is characterised by tabs, comprising a main section projecting from one edge of the sheet. Each main section has a proximal part and a distal part. The distal part of said main section possesses protrusions that leave open recesses. These recesses extend, along the edge of the sheet from which the tab projects, from the base of the main section to the notches between the tabs. The binding is implemented by clenching the main section of the tabs of one sheet into the recesses of an adjacent sheet. Hereby a part of the base of the main section fits exactly or with a minor tolerance into a recess of the tab of an adjacent sheet. These tabs assure a reliable seamless attachment of two successive sheets to a particularly coherent and firm unity, in which the above protrusions act as a catching means.

A preferred embodiment of a binding system according to the invention is characterised by tabs, whose main section has a width tuned to the distance between the main sections of two neighbouring tabs on a consecutive sheet. In particular the width of each main section, at its base, is equal or slightly less than the distance between two adjacent main sections. This is preferable for obtaining a good alignment of successive sheets along the direction of the binding edge.

Another embodiment of the binding system is characterised by tabs, in which between the main section and the protrusions a weakening in the form of a folding line or crease is situated. This facilitates the bending of the protrusions during the insertion of the tabs into corresponding notches of an adjacent sheet. During the binding process, if a tab is inserted into a notch between two corresponding tabs on the other sheet, the protrusions of these tabs are bent so that said first tab can pass through the notch between said corresponding tabs.

A preferred embodiment of the binding system according to the invention is characterised by tabs whose main section comprises, along its base where the tab projects from the rest of the sheet, a weakening in the form of a folding line, perforated line or crease. During the binding process the entire tab can be folded along this folding line to facilitate the above mentioned procedure for the manufacture of books with multiple pages. Also the tabs can be folded exactly along these folding lines to yield a binding side with uniform and beautiful appearance.

Another preferred embodiment of the binding system according to the present invention is characterised by sheets, that comprise the same pattern of tabs, regularly positioned on the binding edge of each sheet. In this case adjacent sheets are turned upside down, so that the tabs of a arbitrary sheet lie directly above the notches of a neighbouring sheet. In this embodiment the binding edge starts with a tab and ends with a notch or the reverse. It offers both an economic and practical advantage as only one type of sheets needs to be used. Without this configuration one needs to use two different types of sheets.

Another embodiment of the binding system according to the invention comprises a first type of sheet, that starts and ends with a tab, and a second type of sheet, that starts and ends with a notch.

A preferred embodiment of a binding system according to the invention is characterised by sheets that comprise a printable material like paper, cardboard or plastic foil. Such materials can be printed easily with various printing techniques. This way sheets can be easily provided with prints if desired.

Another embodiment of the binding system according to the present invention uses tabs that comprise an additional adhesive, in particular a glue layer, hot melt glue layer or self-adhesive layer. This yields a permanent and more powerful attachment of the sheets.

A preferred embodiment of the binding system according to the present invention uses only two sheets to be connected to manufacture a poster. With an ordinary printer the size of the paper is generally limited. Using the present invention one can double the paper size.

The present invention also relates to a sheet for use in a binding system, according to the invention, and the use of the binding system, according to the invention, for the manufacture of books, brochures, magazines, photo albums, posters or other bound matter. To manufacture above bound matters with more than two pages, one first connects two sheets, according to the above described prescription. Then the tabs of the lower sheet are folded back onto the upper sheet. Only the tabs of the upper sheet are left unfolded. A new sheet is placed upon said pair connected sheets, with its tabs positioned directly above the resulting notches of the connected pair. After this the tabs of the new sheet are pushed into these notches. Now the tabs of the middle sheet of the triple are folded back onto the upper sheet of the triple. For more pages one can repeat this procedure.

The present invention will be further elucidated here below with reference to the annexed figures of several examples of embodiments.

FIG. 1 a perspective view of an example of an embodiment of the binding system according to the invention comprising two sheets bound together.

Figure 2:
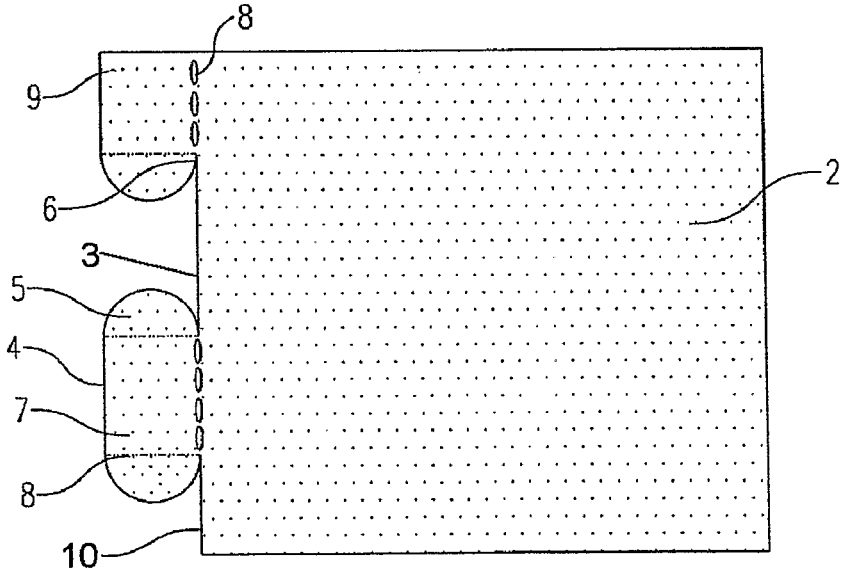

FIG. 2 a top view of an example of an embodiment of a sheet used in the binding system according to the invention.

FIG. 3-8 a top view of the binding edge of six further examples of embodiments of sheets used in the binding system according to the invention.

Figure 9:
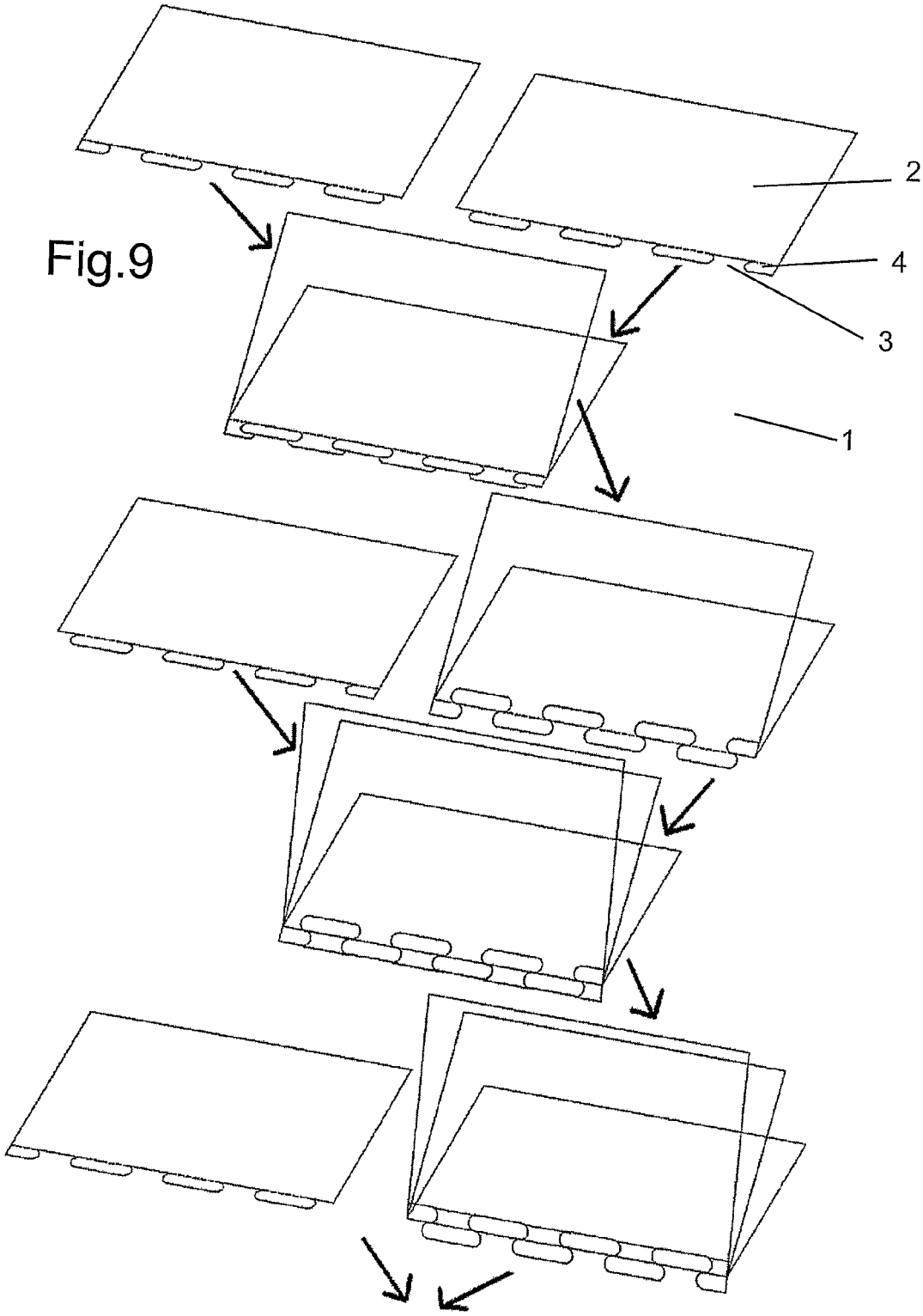

FIG. 9 a perspective view of the consecutive stages of the binding process of the binding system according to the invention.

The figures are otherwise schematic and not drawn to scale. For the sake of clarity some dimensions, in particular, may be exaggerated to a greater or lesser extent. Corresponding parts are designated, as far as possible, in the figures with the same reference numerals.

An example of an embodiment of a binding system according to the invention is depicted in FIG. 1 in perspective view. The binding system 1 comprises two sheets 2 that at their binding edge 3 are provided with attachment means in the form of approximately oval shaped tabs 4. Another suitable shape of the tabs 4 is for instance triangular, square, polygonal, trapezoid or circular. The tabs 4 comprise a main section 7 that on both sides possesses protrusions 5 that leave open recesses 6 adjacent to the binding edge 3 of a sheet 2. During the binding process a main section 7 of a tab 4 belonging to a first sheet 2 is inserted into the recesses 6 of neighbouring tabs 4 of second sheet 2. So a durable mutual attachment is attained. The protrusions 5 form the attachment means hereby.

The main section 7 of a tab 4 has a width tuned to the distance between the main sections 7 of two neighbouring tabs 4 on a consecutive sheet 2. In particular the width of each main section 7, at its base, is equal or slightly less than the distance between two adjacent main sections 7. Hereby a part of the base of the main section 7 fits exactly or with a minor tolerance into a recess 6 of the tab 4 of an adjacent sheet 2. During the binding process, if a tab 4 is inserted into the notch between two corresponding tabs 4 on the other sheet 2, the protrusions 5 of these tabs 4 are bent along the folding lines 8. The folding of the protrusions 5 narrows the width of the tabs 4 to the width of their main sections 7 so that said first tab 4 can easily pass through the notch between said corresponding tabs 4. This folding line 8 can be implemented as a weakening in the form of a crease or line of perforations and facilitates the insertion of the tabs 4 into the notches. For thin and flexible sheet material like for instance paper or thin plastic foil the folding of the protrusions 5 happens of itself during the insertion of the tabs 4 and this crease or line of perforations 8 can be omitted.

In FIG. 1 the two sheets 2 can also be connected to manufacture a poster. Thus the above mentioned example of an embodiment provides for a quick, user-friendly binding system without requiring separate and cumbersome attachment means.

FIG. 2 depicts a top view of an example of an embodiment of a sheet 2 used in the binding system according to the invention. The sheet 2 comprises at its binding edge 3 attachment means in the form of approximately oval shaped tabs 4. The tabs 4 comprise a main section 7 that on both sides possesses protrusions 5 that leave open a recess 6 adjacent to the binding edge 3 of the sheet 2. During the binding process a main section 7 of a tab 4 belonging to first sheet 2 is inserted into the recess 6 of the tabs 4 of second sheet 2. So a durable mutual attachment is attained. The protrusions 5 form the attachment means hereby. The tabs 4 are also provided with a folding line in the form of a crease or perforated line 8 along the base of the main section 7, where the tabs 4 project from the binding edge 3 of the sheet 2 . This also facilitates the insertion of tabs 4 of a sheet 2 into the notches between the tabs 4 of an adjacent sheet 2 and the successive folding of the tabs 4 flat onto that adjacent sheet 2. In this figure the binding edge starts with a begin-tab 9 and ends with a end-notch 10. To assure a proper alignment of successive sheets 2 along both edges orthogonal to that binding edge 3, the width of the main section 7 of the begin-tab 9 must be equal or slightly less than the width of the end-notch 10. Also the begin-tab 9 comprises only one protrusion.

Figure 3:
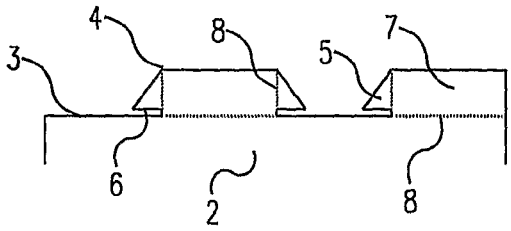

The FIGS. 3 up to and including 8 show a top view of the binding site in six examples of embodiments of sheets used in a binding system according to the present invention. FIG. 3 depicts a sheet 2 with approximate trapezoid tabs 4.

Figure 4:
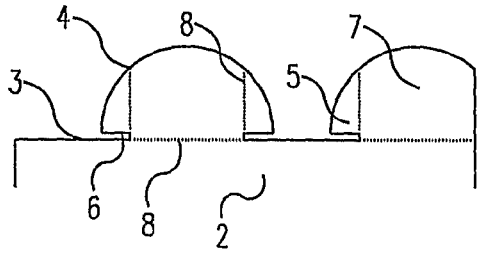

FIG. 4 shows a sheet 2 with approximate half-circular tabs 4.

Figure 5:
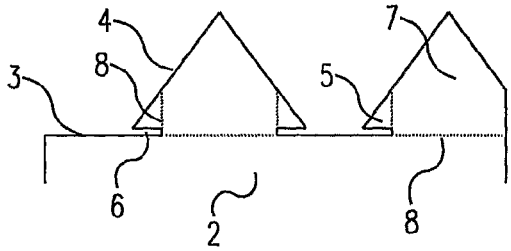
Figure 6:
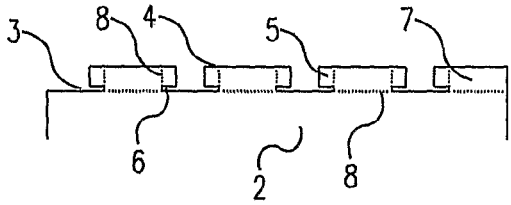
Figure 7:
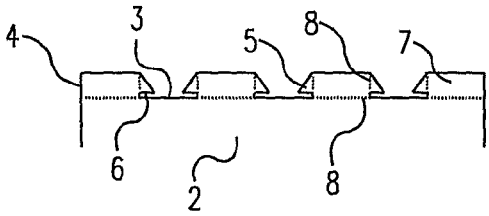
Figure 8:
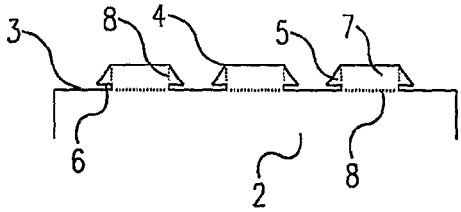

FIG. 5 depicts a sheet 2 with approximate triangular tabs 4. However the binding edge 3 can encompass tabs 4 with many other shapes and variations. FIG. 6 shows a binding edge 3 with rectangular tabs 4. In all these examples only one type of sheet 2 is used in the binding system. The number of tabs 4 on the binding edge 3 of the sheet 2 can vary if desired. FIG. 7 depicts a sheet 2 with trapezoid tabs 4 in which both ends of the binding edge 3 comprise a partial tab 4. FIG. 8 shows a sheet 2 with trapezoid tabs 4 in which both ends of the binding edge comprise a notch or tab-less part. Sheets according to the FIGS. 7 and 8 complement each other and are alternately bound together.

FIG. 9 depicts a perspective view of the consecutive stages of the binding process according to an embodiment example of the present invention. The binding system 1 comprises a stacking of sheets 2, that, at their binding edge 3, are provided with tabs 4. To manufacture booklets with more than two pages, one first connects two sheets 2 by inserting the tabs 4 of the upper sheet 2 between the tabs 4 of the lower sheet 2. Then the tabs 4 of the lower sheet 2 are folded back onto the upper sheet 2 and lie flat on this upper sheet 2. Only the tabs 4 of the upper sheet 2 are now left unfolded. A new sheet 2 is placed upon said pair connected sheets 2, with its tabs 4 positioned directly above the resulting notches between the tabs 4 of the upper sheet 2 in the connected pair. After this the tabs 4 of the new sheet 2 are pushed into these notches. Now the tabs 4 of the middle sheet 2 of the triple are folded back onto the upper sheet 2, and lie flat on this upper sheet 2, of the triple. One can repeat this procedure to create a booklet with any desired number of pages.

Although the invention was illustrated further with some embodiment examples, the present invention is certainly not limited to these. On the contrary, for the average professional many other variations and designs are possible within the scope of the invention. The sizes, shapes and number of tabs and sheets can vary if desired. Also the tabs do not need to be an integral part of the sheets but can be fastened to the sheets afterwards.

The invention claimed is:

1. Binding stacking comprising:

a first and a second stackable sheet that are mutually connectable at a common binding side by attachment means, the first sheet adjacent to the second sheet, tabs comprised by the attachment means at the binding side, the tabs projecting from the sheets and formed integrally with the sheets such that the tabs and the sheets have a uniform thickness, and the tabs having a base width being the width of the tab at substantially the binding side of the sheet, notches defined between the tabs, the notches having a base width, the base width of the tabs and the notches is substantially the same, the tabs of the first sheet are suitable for positioning into the notches of the second sheet to provide for a mutual attachment of those sheets along the binding side along a straight folding line, and in that, the tabs each comprise a main section having a protrusion at one or both sides that are projecting from this main section and that are defining open recesses along the edge of a sheet from which the tab projects whereby a part of the base of the main section of a tab substantially fits into a recess of the tab of an adjacent sheet, and the tabs of the first and second sheets providing a direct interconnecting effect by a protrusion of a tab of the first sheet being in contact with a protrusion of a tab of the adjacent second sheet.

2. Binding stacking according to claim 1 in which tabs of the first and second sheets are interlockable and hookable into each other.

3. Binding stacking according to claim 1 in which the notches comprise a bottom line that is straight and in line with the binding side of the sheet.

4. Binding stacking according to claim 1 in which the tabs of the first sheets are foldable over the bottom of a notch of the second sheet.

5. Binding stacking according to claim 1 in which the tabs are characterised by a main section that comprises, along its base where the tab projects from the rest of the sheet, a weakening embodied by a folding line, perforated line or crease.

6. Binding stacking according to claim 1 in which the tabs are characterised by a weakening in the form of a folding line, perforated line or crease between main section and the protrusions.

7. Binding stacking according to claim 1 wherein the first and second sheets comprise one type of sheet that is characterised by an alternating sequence of tabs and notches on the binding side and that the sequence starts with a tab and ends with a notch.

8. Binding stacking according to claim 1 wherein the first and second sheets comprise two complementary types of sheets that are characterised by two different patterns of tabs and notches and the binding edge of each sheet either starts with a tab and ends with a tab or starts with a notch and ends with an notch.

9. Binding stacking according to claim 1 characterised by sheets comprising a printable material.

10. Binding stacking according to claim 9 wherein the printable material comprises one of paper, cardboard, and plastic foil.

11. Binding stacking according to claim 1 that is characterised by tabs comprising additional attachment means.

12. Binding stacking according to claim 11 wherein the additional attachment means comprises one of a glue, a self-adhesive layer, and a hot-melt layer.

13. A binding stacking according to claim 1 manufactured by stacking sheets of one of a book, magazine, poster, photo-album and other bindable material wherein the first sheet that is attachable to the second sheet by inserting its tabs into the notches of the second sheet, after which the tabs of the first sheet are folded onto the second sheet and a new third sheet identical to the first sheet is placed onto the second sheet, with its tabs insertable into the notches of that second sheet, after which the tabs of the second sheet are folded onto that third sheet and eventually more sheets can be attached to this triple in the same way.

14. A set of bound sheets comprising:

a first sheet having a first series of tabs including at least one full tab and at least one partial tab along a binding side, each full tab having a base width and a main section with a protrusion on at least one side of the full tab, the first series of tabs spaced apart to define at least one notch between the tabs, the at least one notch having a base width substantially the same as the base width of each full tab, the first series of tabs integrally formed with the first sheet such that there is a uniform thickness of the tabs and the sheet;

a second sheet adjacent to the first sheet, the sheet having a second series of tabs including at least one full tab and at least one partial tab along a binding side, each full tab in the second series of tabs having a base width and a main section with a protrusion on at least one side of the full tab, the second series of tabs spaced apart to define at least one notch between the tabs, the at least one notch having a base width substantially the same as the base width of each full tab, the second series of tabs integrally formed with the second sheet such that there is a uniform thickness of the tabs and the sheet; and a third sheet adjacent to the second sheet, the sheet having a third series of tabs including at least one full tab and at least one partial tab along a binding side, each full tab in the third series of tabs having a base width and a main section with a protrusion on at least one side of the full tab, the third series of tabs spaced apart to define at least one notch between the tabs, the at least one notch having a base width substantially the same as the base width of each full tab, the third series of tabs integrally formed with the third sheet such that there is a uniform thickness of the tabs and the sheet;

wherein the first series of tabs is offset from the second series of tabs;

wherein the first series of tab is aligned with the third series of tabs;

wherein the first sheet is connected to the second sheet by interconnecting the first series of tabs through the at least one notch of the second sheet, and folding the first series of tabs; and wherein the second sheet is connected to the third sheet by interconnecting the second series of tabs through the at least one notch of the third sheet and folding the second series of tabs.

15. The set of bound sheets of claim 14 further comprising an adhesive;

wherein the adhesive is used to adhere the first series of tabs to the second sheet; and wherein the adhesive is used to adhere the second series of tabs to the third sheet.

16. A set of bound sheets comprising:

a first stackable sheet having a binding side with a first series of tabs extending therefrom, each tab having a base width being the width of the tab along the binding side of the sheet, each tab having a main section with a protrusion projecting from the main section, the tabs defining a first series of notches between the tabs, each notch having a base width being the width of the notch along the binding side of the sheet, the base width of the tabs and the base width of the notches being substantially the same, the sheet and the tab having a uniform thickness; and a second stackable sheet having a binding side with a second series of tabs extending therefrom, each tab having a base width being the width of the tab along the binding side of the sheet, each tab having a main section with a protrusion projecting from the main section, the tabs defining a second series of notches between the tabs, each notch having a base width being the width of the notch along the binding side of the sheet, the base width of the tabs and the base width of the notches being substantially the same, the sheet and the tab having a uniform thickness;

wherein the first series of tabs is offset from the second series of tabs; and wherein the first sheet is connected to the second sheet by placing the tabs of the first sheet through the notches of the second sheet such that the protrusions on the series of tabs of the first sheet overlap and are in direct contact with the protrusions on the series of tabs of the second sheet.

17. The set of bound sheets of claim 16 wherein the series of tabs on the first sheet and the series of tabs on the second sheet are unfolded when the first sheet is connected to the second sheet.

18. The set of bound sheets of claim 16 wherein the series of tabs of the first sheet and the series of tabs of the second sheet form a binding when the first sheet is connected to the second sheet; and wherein the thickness of the binding is the same as the thickness of the first and second sheets.

* * * * *